US005873335A

United States Patent [19]

Wright et al.

[11] Patent Number: 5,873,335

[45] Date of Patent: Feb. 23, 1999

[54] ENGINE VALVE ACTUATION CONTROL SYSTEM

[75] Inventors: Danny O. Wright, Cobb's Creek; James A. Nitkiewicz, Newport News, both of Va.

[73] Assignee: Siemens Automotive Corporation, Auburn Hills, Mich.

[21] Appl. No.: 5,632

[22] Filed: Jan. 9, 1998

[51] Int. Cl.[6] ..... F01L 9/04

[52] U.S. Cl. ..... 123/90.11; 123/90.31; 123/198 D

[58] Field of Search ..... 123/90.11, 90.15, 123/90.31, 90.6, 90.65, 198 D

[56] References Cited

U.S. PATENT DOCUMENTS

| | | | |
|---|---|---|---|
| 4,256,065 | 3/1981 | Hirt | 123/90.11 |
| 5,016,583 | 5/1991 | Blish | 123/90.11 |
| 5,327,856 | 7/1994 | Schroeder et al. | 123/90.11 |
| 5,331,931 | 7/1994 | Blish et al. | 123/90.11 |
| 5,598,814 | 2/1997 | Schroeder et al. | 123/90.11 |

FOREIGN PATENT DOCUMENTS

| | | | |
|---|---|---|---|
| 2-259212 | 10/1990 | Japan | 123/90.11 |

OTHER PUBLICATIONS

Henry et al; A Novel, Fully Flexible, Electro–Mechanical Engine Valve Actuation System; Society of Automotive Engineers Pub. #970249, 1997.

*Primary Examiner*—Weilun Lo

[57] ABSTRACT

There is shown an electric motor control of the engine valves of an internal combustion engine. A brushless torque actuator controls the rotation of a cam member which provides the appropriate lift to the engine valve to move the valve from the closed to the open position. The electronic control which is connected to the actuator includes a look-up table for controlling the timing of the engine in accordance with the operation of the internal combustion engine. The electronic control operates to return the cam member to its home position closing the engine valves.

9 Claims, 2 Drawing Sheets

ENGINE VALVE ACTUATION CONTROL SYSTEM

FIELD OF INVENTION

This invention relates to the control of engine valves in internal combustion engines and more particularly to electric motor means control thereof.

BACKGROUND OF INVENTION

Prior art control, as found on many applications of internal combustion engines, of engine valves is by means of timing cams positioned on a timing cam shaft which is operatively connected to the engine. Since this is a mechanical control and the cams are fixed, variations in timing of the operation of the valves is not possible.

Other prior art control is by means of controlling the flow of hydraulic fluid to and from solenoid valves which are aligned with the valve stems. One example of such a system is in U.S. Pat. No. 4,61 5,308 assigned to a common assignee by Wakeman, and entitled "Engine Valve Timing Control System". This form of control will allow a change in either the opening or the closing of the engine valve, but since the prime mover is still a cam, large variations in operational timing are not available to the engine performance designer.

U.S. Pat. No. 5,598,814, issued on Feb. 4, 1997, entitled "Method and Apparatus for Electrically Driving Engine Valves", describes a motor control including position transducers for generating crankshaft position and motor position pulse trains. The pulse trains are compared to detect any phase difference between engine and motor positions. Tables are generated to define the desired phase difference needed for particular valve characteristics. The phase difference represents the instantaneous deviation from the basic profile. One of the tables is selected according to the engine conditions and the motor is driven to achieve the desired phase differences.

SUMMARY OF INVENTION

The limitations of the aforementioned systems namely a restriction in the range of valve control are not found in the embodiment as described herein. An electrical motor control system for the actuation of engine valves of internal combustion engines operates to control and reduce the amount of energy which must be added to operate the engine valves. The engine has at least one cylinder and at least one engine valve connected to the cylinder that is mounted for reciprocal motion in a cylinder head of the engine. The engine valve is operatively connected to the engine valve. The engine valve has a valve stem and a valve member normally closing an opening into the cylinder for controlling the flow of fluids such as a fuel-air mixture or an exhaust gas mixture to and from the cylinder. A first bias means mounted on the valve stem biases the valve in a closed position. The valve member is mounted on the valve stem at the cylinder opening.

A cam member is operatively coupled to the opposite end of the valve stem from the valve member for controlling the amount of reciprocal travel of the engine valve in the cylinder head from a valve open to a valve closed position. An electric motor means is operatively coupled to the cam member for providing the torque necessary to rotate the cam member.

An electronic motor control means is connected to the electric motor for controlling the rotation of the drive shaft of the motor at a time that is in accordance with the desired opening and closing times of the valve. A second bias means is operatively coupled to the cam member, for preloading the cam member for normally closing the valve. Thus, a pair of bias means provides the necessary energy to operate the engine valves and the motor means provides enough energy to the system to overcome frictional losses in the mechanical structure.

These and other attributes of the invention are described in the accompanying description and the attached drawings of the preferred embodiment:

DETAILED DESCRIPTION

Figure 1:
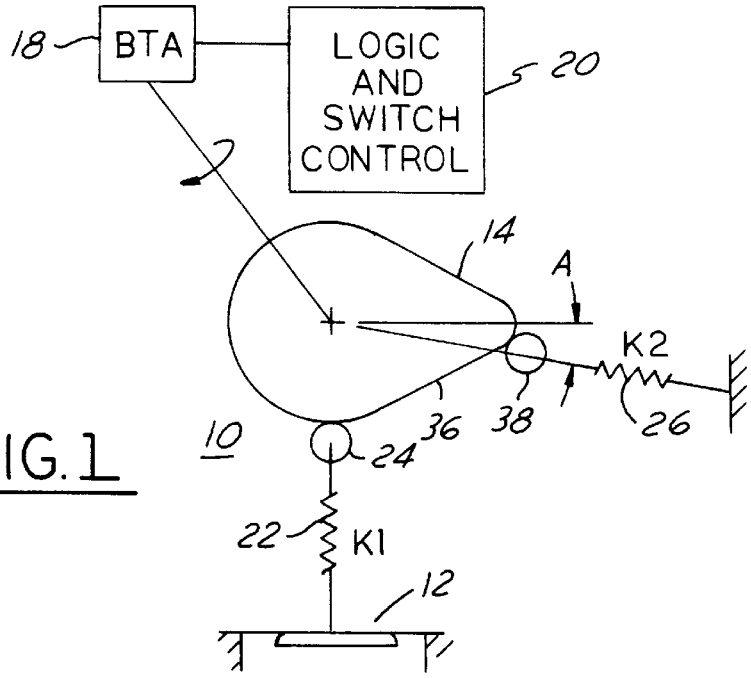
FIG. 1 is a schematic illustration of the preferred embodiment of the control system.

Referring to the Figs by the characters of reference there is shown in FIG. 1 a schematic representation of the principles of the present embodiment of an electric motor control system 10 for controlling the actuation of engine valves 12 as found in internal combustion engines. In FIG. 1, there is illustrated a timing cam 14 secured to a shaft 16 driven by a motor means 8. In the Figure the motor means 18 is identified as a Brushless Torque Actuator or BTA. The BTA is controlled by a logic and switching control circuit 20. Connected to the cam 14 through a first bias means or spring 22 having a spring force of K1, is a typical engine valve 12. The engine valve 12 will operate by following the periphery of the timing cam 14 by means of a cam follower 24. A second bias means or spring 26 having a spring force of K2 is operatively connected to the cam 14 at an angle A from an axis that is orthogonal to the valve stem 28.

As the cam 14 is rotated through substantially ninety degrees, the first bias means 22 compresses storing potential energy. At the same time, the second bias means 26 elongates and thereby dissipates kinetic energy which is effectively translated into the potential energy stored in the first bias means 22. Since this is not a perfect, frictionless system, the output of the BTA 18 supplies additional energy to overcome the frictional losses and the moment of inertia of the system. Such energy supplied by the BTA 18 is much less than that found in present timing cam systems. It is this transfer of energy from one bias means to the other bias means that provides the major force to open and close the engine valve 12.

If the first and second bias means 22, 26 were balanced and the angle A is zero and the system would be stable except for certain frictional losses. However by increasing the angle "A" or unbalancing the first and second bias means, the system will have a normal position when the BTA 14 is turned off. Ideally, if the spring constant K2 is larger than the spring constant K1, the normal position will be with the engine valve 12 closed. This allows the engine to function as a braking device and help bring the vehicle to a stop. Thus, when all electrical power fails, the "fail-safe" position is with all valves closed.

Figure 2:
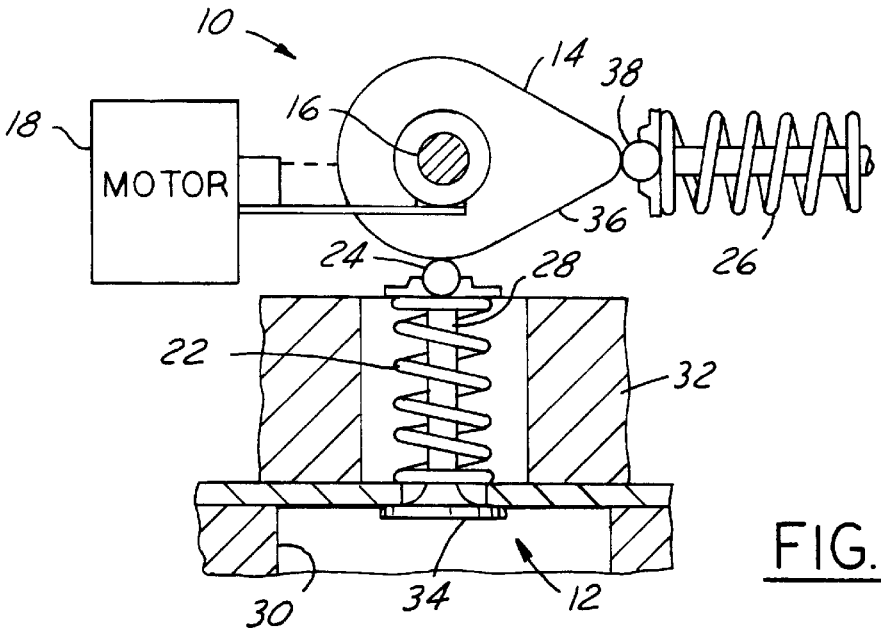
FIG. 2 is a schematic drawing of the mechanical portion of the control system.

In FIG. 2, the engine that typically has four or more cylinders, but the principles of the embodiment apply to engines having at least one engine cylinder 30. The cylinder 30, for the purposes of this embodiment, is located in an engine block and has a cylinder head 32 extending over the top of the cylinder. Located in the cylinder head 32 are several passageways for the passage of various fluid mixtures to and from the cylinder 30. The intake valve receives air-fuel mixtures which upon ignition cause the piston in the cylinder 30 to reciprocate. Upon burning of the air-fuel mixture, the exhaust gas is discharged from the exhaust valve to another passage. It has been found that if the timing of the opening and the closing of the valves 12 could be controlled, the performance of the engine can be enhanced.

Each cylinder 30 has one or more engine valves 12 controlling the flow of the air-fuel mixture and the exhaust gas to and from the is cylinder 30 respectively. Each engine valve 12 has a valve stem 28 which axially extends from the valve member 34 to a location wherein a timing cam 14 mechanism is located. Each engine valve 12 has a first bias means or valve spring 28 which is typically surrounding the valve stem 28 and is mounted to normally close the engine valve 12. The end of the valve stem 28 is normally coupled to a timing cam 14 by means of a cam follower 24 mechanism.

Figure 3:
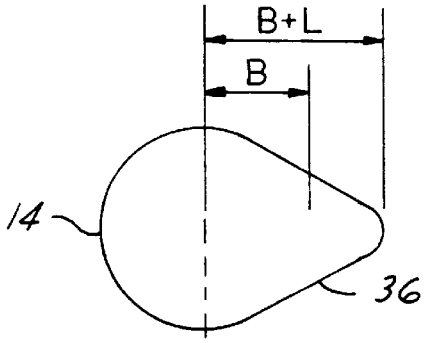
FIG. 3 is a plan view of a typical cam in the preferred embodiment.

It is the function of the cam member 14 to provide the timing and the amount of force necessary to reciprocally move the engine valve 12. Since the cam 14 is connected to a rotating shaft 16, the force is transmitted to the valve stem 28 as a result of the rotation of the cam shaft 16. The design of the typical cam 14 is illustrated in FIG. 3. The cam 14 has a base circle radius "B" from which extends a peripheral surface 36 which extends outward for a dimension equal to the radius B of the base circle plus the desired lift "L" dimension. FIG. 1 shows the second bias spring 26 which has a cam follower 38 mechanism for riding on the cam peripheral surface 36. As the cam follower 38 rolls on the cam surface 36, the second bias means 26 extends for releasing kinetic energy and the first bias means 22 compresses to store potential energy. When the motor control 20 indicates that the valve 12 should be open, the cam follower 24 rides along the cam surface 36 until it reaches the maximum length B+L. In this case, the first bias spring 22 releases its energy as kinetic energy to rotate with the cam 14 effectively transferring the kinetic energy to the second bias spring 26 as potential energy. The motor means 18 functions to supply energy to overcome frictional losses in the mechanical system.

Figure 4:
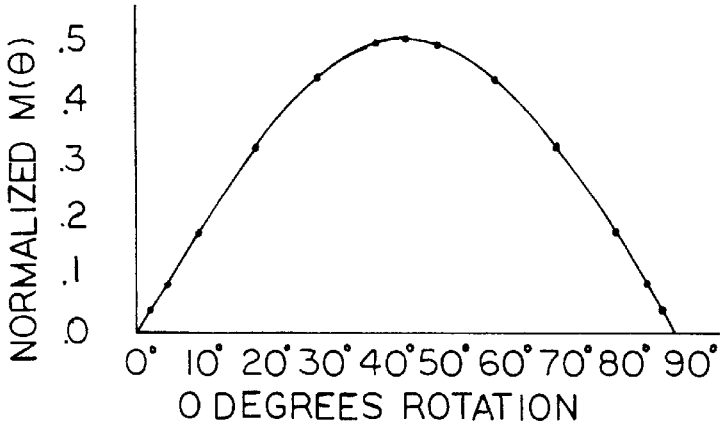
FIG. 4 is a graph of the moment about the cam center of rotation verses the degrees of rotation of the cam.

FIG. 4 illustrates a plot of the moment of the cam 14 through its rotation. The second bias spring 26 must act on the cam 14 to oppose the cam moment illustrated. In this manner the cam 14 will follow the rotation of the motor shaft. It is important that the second bias means 26 is positioned transverse to the first bias means 22. If the first and second bias means were balanced, then the motor 14 only has to overcome the frictional losses and the inertia of the moving masses to actuate the valve 12. However, the preload of the first bias means 22 is slightly larger than the preload of the second bias means 26 causing the unenergized or fail safe position of the system to be with the valve 12 closed. With the valve closed when the electric power is removed from the motor means 18 allowing the motor to essentially free-wheel, engine braking is provided to slow the vehicle down and stop it with the engine turned off.

In most applications, the operation of the crankshaft of the engine, is coupled to the cam shaft providing the rotational movement. An electric motor means 18 is operatively connected to the cam 14 and replaces the conventional drive from the crankshaft of the engine. Electrically connected to the motor means 18 is an electronic logic and switch control means 20 which functions to control the power to the motor. The motor means 18 operates to drive the rotation of the cam 14 through an angle of ninety degrees. In some instances, the motor control 20 will cause the motor to reverse and to rotate the cam 14 back to its normal position. It is contemplated that each engine valve 12 or common group of engine valves will have a motor means 18 controlling the rotation of the cam 14. As previously stated, the motor means 18 may be a Brushless Torque Actuator, "BTA", which is a rotary, non-axial stroke, actuator.

The BTA 18 has a single phase coil with multiple stator poles and matching rotor poles. When the coil is energized, the poles align along the flux path. In the preferred embodiment, the BTA has a normal stroke rotation of forty-five degrees. However the BTA can be made to rotate an additional forty-five degrees in the same direction by electronic switching, the cam 14 will effectively rotate another forty five degrees in the same direction so that the output is substantially a ninety degree rotation. In the graph of FIG. 4, the initial rise of the curve is through two forty-five electrical degrees from the base line to the top of the curve and in a similar manner, the return slope is two forty five degree electrical segments in the reverse direction. The BTA 18 is energized to rotate the cam 14 in one direction such as to open the valve 12 and then is reversed to rotate the cam to close the valve. With the first 22 and second 26 bias springs positioned such that the direction of the spring forces are not co-axial, as the cam 14 rotates one spring is compressed storing potential energy, the second spring is extended to dissipate kinetic energy and then when the cam 14 is reversed, the energy transfer is reversed as stated above.

In the electronic logic and switch control means 20 there is logic means responsive to a look-up table which responds to several engine parameters such as rpm, temperature, manifold pressure, to name but a few parameters that dictate the operation of the engine. Depending on the results of the look-up table the motor means or rotary position encoder or BTA 18, is caused to rotate, hence causing the cam 14 to rotate. As previously indicated, the rotation of the cam is translated into reciprocal motion of the valve stem 28.

Operatively connected to the cam 14 is a second bias means 26 for preloading the cam to a predetermined force. In the system, the force developed by the second bias means 26 is slightly less than the force developed by the first spring means 22 on the valve stem 28, although in some instances, the springs may be balanced. This difference in force will make sure that the "fail-safe" position of the engine valve 12 is in a closed position. The second bias means 26 causes the cam 14 to rotate to its normal position wherein the first bias means 22 is extended to its normal position closing the valve 12. It is noted that when the springs are unbalanced as described above that when the engine is not operating and the power is turned off to the motor means 18, all the valves in the engine are closed. The effect of spring unbalance can also be accomplished by offsetting the cam followers 24, 38 and balancing the springs.

If the motor means is a torque motor, which is defined as a motor capable of generating large amounts of torque at its output, the motor must develop large torque values in a small angular rotation of ninety degrees. This is because the valve system has heavy spring and pressure forces. In the system the output of the motor is geared down so that the motor will cause only a small rotation, ninety degrees, of the cam. By proper design of the cam in all embodiments, the opening and closing of the valve member can be controlled as to speed and force of seating. This is important so that the "landing" of the valve member on the valve seat is relatively quiet.

Figure 5:
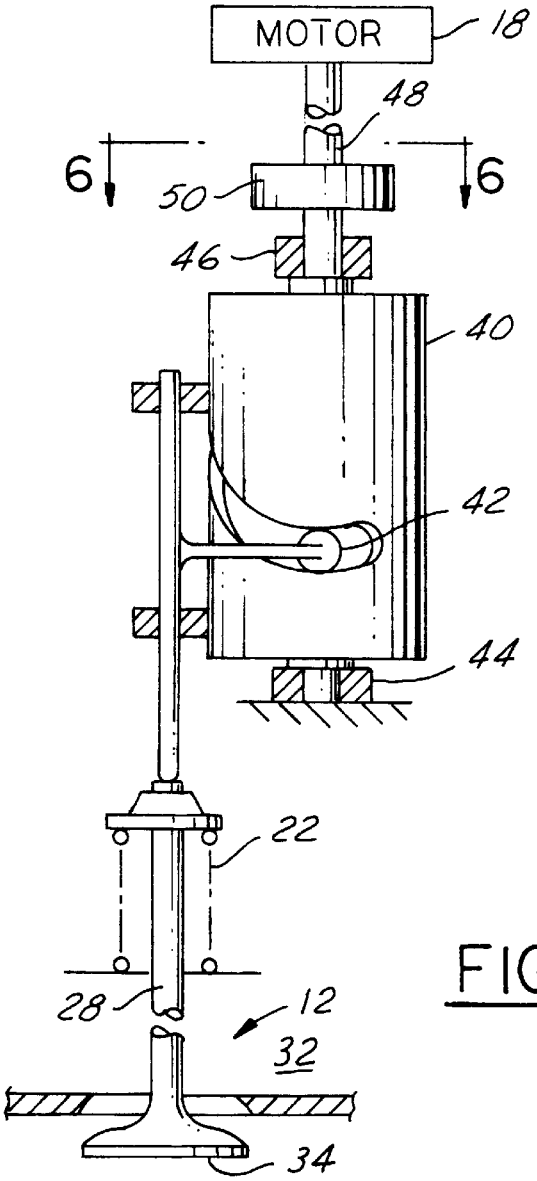
FIG. 5 is a schematic view of an alternate cam means.

In an alternative embodiment as illustrated in FIG. 5, the cam 14 is a barrel cam member 40 operatively connected to the valve stem 28. The barrel cam 40 is typically mounted in parallel with the valve stem 28 and a cam follower 42 follows a helical path on the face of the cam 40. The axis of the of the barrel cam 40 is mounted between bearings 44, 46 and at one end of the cam shaft 48 is a return cam mechanism 50, FIG. 6. The return cam mechanism 50 is operatively biased to drive the valve stem 28 in a direction to normally close the valve 12. The electric motor means or BTA 18 is operatively connected to rotate the cam 40 and functions similar to the embodiment of FIG. 2. Again this embodiment can be made to function to return the valve to its closed position in a fail-safe manner. The motor control rotates the cam 40 through a predetermined number of degrees and then counter rotates the cam 40 back to its home position. The cams 40, 50 are designed so that the valve operation is such that the valves have a soft landing to maintain quiet valve operation.

Figure 6:
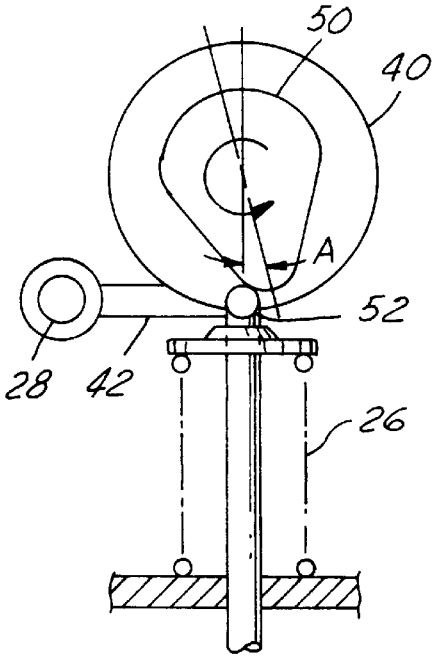
FIG. 6 is a plan view of the return cam of FIG. 5 taken along line 6—6 in FIG. 5.

The embodiment of FIG. 6 illustrates a cam member 50 having two independent cam follower mechanisms 42, 52. The first cam follower mechanism 42 operates to move the valve 12 from a closed position to an open position. The second cam follower mechanism 52 operates to provide a counter moment to return the valve 12 to its closed position. The second independent cam follower mechanism 12 is located in an offset position by a predetermined angle "A". The reason for this angle A is provide a small counter moment to return the valve 12 back to the closed position when the motor output is effectively disconnected.

It is to be appreciated that while the several components of the system have been illustrated as separate and unique members, various designs can incorporate the timing cam into the cam package connected to the motor. The electronic control of the motor can be accomplished by an electronic control unit similar to that used in the control of the engine.

What is claimed is:

1. An electrical motor control system for the actuation of engine valves of internal combustion engines comprising:

an engine having at least one cylinder and at least one engine valve mounted for reciprocal motion in a cylinder head of said engine, the engine valve having a valve stem, a valve member connected to said valve stem normally closing an opening to said cylinder for controlling the flow of fluids to and from said cylinder, and a first bias means mounted on said valve stem for biasing said valve in a closed position;

a cam member operatively coupled to said valve stem of said at least one engine valve, said cam member controlling the amount of reciprocal travel of the engine valve;

electric motor means operatively coupled to said cam member for rotating said cam member;

an electronic control means connected to said motor means for rotating the shaft of said motor means in accordance with the desired opening and closing times of said valve; and a second bias means operatively coupled to said cam member, said second bias means for preloading said cam member; wherein the energy transfer between the first and second bias means is translated into reciprocal motion of the valve stem and said electric motor means supplies enough additional energy to overcome frictional losses.

2. An electrical motor control system for the actuation of engine valves according to claim 1 wherein said motor means is a brushless torque actuator.

3. An electrical motor control system for the actuation of engine valves according to claim 1 wherein said first bias means has a working force greater than the working force of said second bias means.

4. An electrical motor control system for the actuation of engine valves according to claim 1 wherein said motor control means is operable to drive said motor means to reciprocally rotate said cam means through an angle of ninety degrees.

5. An electrical motor control system for the actuation of engine valves according to claim 1 wherein said cam means is a barrel cam member operatively connected to said valve stem.

6. An electrical motor control system for the actuation of engine valves according to claim 5 wherein said barrel cam member is operatively biased to drive said valve stem in a direction to normally close said valve.

7. An electrical motor control system for the actuation of engine valves according to claim 1, wherein said cam means includes two independent cam follower mechanisms wherein one follower mechanism operates to open said valve under control of the electrical control means and the other of said independent cam follower mechanisms operates to provide a counter force for returning said valve to its closed position.

8. An electrical motor control system for the actuation of engine valves according to claim 1 wherein said second bias means is mechanically positioned orthogonal to said first bias means, and said first and second bias means are essentially unbalanced.

9. An electrical motor control system for the actuation of engine valves according to claim 1 wherein said second bias means is mechanically positioned transverse to said first bias means, and said first and second bias means are essentially balanced whereby said engine valve is normally closed.

* * * * *